United States Patent [19]

Leete, II et al.

[11] Patent Number: 4,835,932

[45] Date of Patent: Jun. 6, 1989

[54] D-SECTION STRUCTURAL TUBES

[75] Inventors: John H. Leete, II, Manhattan Beach; William J. Skinner, Redondo Beach, both of Calif.

[73] Assignee: TRW Inc., Redondo Beach, Calif.

[21] Appl. No.: 194,066

[22] Filed: May 13, 1988

[51] Int. Cl.[4] ..... E04H 12/00

[52] U.S. Cl. ..... 52/648; 52/108; 52/730; 52/731

[58] Field of Search ..... 52/108, 640, 730, 731

[56] References Cited

U.S. PATENT DOCUMENTS

| | | | |
|---|---|---|---|
| 3,913,105 | 10/1975 | Williamson et al. | 52/108 X |
| 4,259,821 | 4/1981 | Bush | 52/648 X |
| 4,308,699 | 1/1982 | Slush | 52/648 X |
| 4,460,288 | 7/1984 | Schaff | 52/648 X |
| 4,765,114 | 8/1988 | Wesselski | 52/648 X |

*Primary Examiner*—David A. Scherbel
*Assistant Examiner*—Jerrold D. Johnson
*Attorney, Agent, or Firm*—Ronald M. Goldman

[57] ABSTRACT

Structural members for a frame or truss are formed of two substantially identical elongated tubular like members each having a planar extending wall with the tubular members joined together along the planar wall, "back to back", and end portions of the joined planar walls form extending lugs. A complementary joint fitting includes a clevis having a slot for receiving the lug.

8 Claims, 2 Drawing Sheets

D-SECTION STRUCTURAL TUBES

ORIGIN:

The invention described herein was made in performance of work under NASA Contract No. NAS3-23790 awarded by the National Aeronautics and Space Administration and is subject to the provisions of Public Law No. 85-568 (72 Statute 435; 42 U.S.C. 245).

FIELD OF THE INVENTION

This invention relates to a structural member and, more particularly, to a hollow light weight structural member and fitting useful in the assembly of a truss or frame and to a process of fabricating such structural member.

BACKGROUND

A structural frame, such as that used to support an antenna reflector of a microwave antenna, is constructed from individual frame members which are interconnected by means of structural joints. In aerospace industry application, the frame members in common practice are tubular; more specifically, cylindrical, in shape. End fittings are attached to the tube ends such that individual members can be connected to joints. The interconnected members then form a structural truss or three dimensional frame. The design, analysis, fabrication, assembly and testing of the end fittings is usually a time consuming part of the manufacturing and frame assembly process.

An object of the present invention is to provide a frame member and frame joint assembly that eliminates end fittings. A further object is to enable construction of a frame assembly with a fewer number of parts and of consequent lesser weight than prior comparable assemblies in common use in aerospace application.

The present invention provides for a frame member that is light in weight, employs simplified and less time consuming manufacturing and testing processes, and is easy to assemble into a two dimensional truss and/or three dimensional frame.

SUMMARY OF THE INVENTION

Structural members for a frame or truss are formed of two substantially identical elongated tubular like members each having a planar extending wall with the tubular members joined together along the planar wall, "back-to-back", to form a common wall of double thickness and having end portions of the joined planar walls form lugs. A complementary joint fitting includes a double clevis defining a slot to receive the frame member lug. In an additional aspect the frame members outer walls are cut away or terminates short of the lug end and are tapered from a predetermined distance behind that lug end so as to form side wall portions to the right and left side of the lug, leaving the major end area of the planar wall or lug exposed to provide access for mechanical fastener installation. The cut away end portion also provides clearance between adjacent frame members that are joined at an acute included angle to a common joint.

In another aspect the structural members have a constant cross-section, which allows manufacture by extrusion or by laying up layers of composite impregnated cloth or tape materials upon a mandrel.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
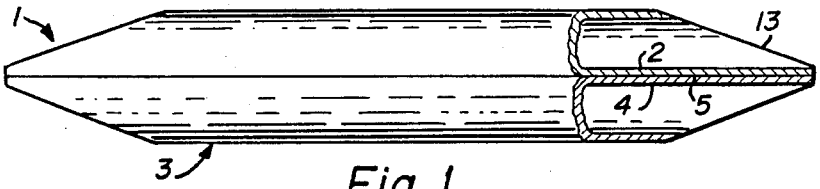
FIG. 1 illustrates a preferred embodiment of the invention in side elevation view.

As illustrated in figure in side view, a preferred embodiment of the frame member includes a first elongated section 1, containing a planar wall 2, and a second identical section 3 containing a planar wall 4. The two members are joined together into an integral or unitary assembly at the center or parting line 5 along the respective planar walls 2 and 4 to define a common wall of double thickness, as compared to the thickness of the other walls as represented by the dash lines about parting line 5 in the figure. As illustrated in the top view of FIG. 2, the right end of the section includes a portion in which the major portion of curved upper wall 1 is recessed from or terminates as at 9 short of the right end of the frame member by a predetermined length to expose in top view the tenon or lug end 7. The wall is sliced or cut away at an angle toward the planar wall to taper the end. The taper is such that at the front end a slight lip or edge 14 remains on the wall sides bounding the planar wall. The remaining portions of the wall in the cut away end portion to the right and left sides of the formed lug serve as reinforcement to provide rigidity and strength at the end.

A hole or passage 11 is formed through the lug end, which is a bolt receiving hole. The location and number of mechanical fasteners is dependent on the load and stiffness requirements for a particular structural member. Some local strengthening of the lug end may be required to carry fastener loads. Alternatively, the D-section structural members may be adhesively bonded to the joint clevises without mechanical fasteners. In this alternative, the clevis is bonded directly to the lug, hole 11 is omitted and local strengthening of the lug end is unnecessary.

Figure 2:
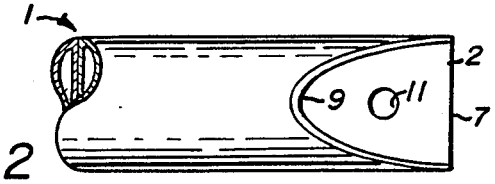
FIG. 2 is a partial top view of the right end of the embodiment of FIG. 1.

The geometry of the right end of the member as viewed from the bottom, not separately illustrated, is substantially identical in structure to the top view. The left end top and bottom views, though not illustrated in FIG. 2, are essentially identical to the right end and is a mirror image of the right end. The tubular sections forming the frame member are essentially symmetrical in structure about center or parting line 5 and are essentially symmetrical about a mid or dividing line extending perpendicular to the member.

Figure 3:
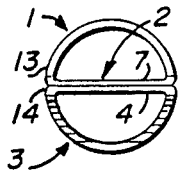
FIG. 3 is a right end view of the embodiment of FIG. 1.

As illustrated in the right end view of FIG. 3, the walls about the planar wall are curved, essentially semicircular in section. As is evident the cross section of each tube is of the form of the english letter capital D, hence, reference may be made to the individual sections as D-section tubes.

Figure 4:
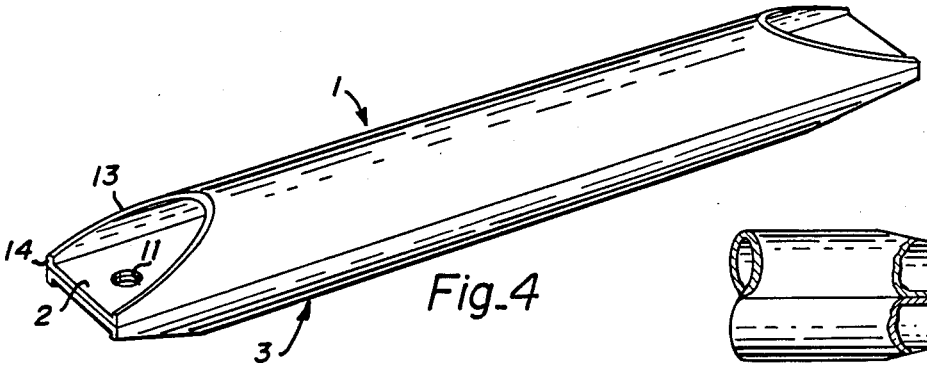
FIG. 4 illustrates the embodiment in perspective view.
Figure 5:
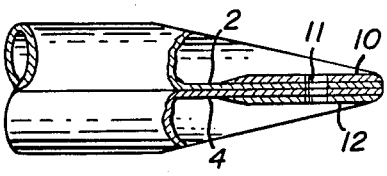
FIG. 5 is a right partial section view of an alternative embodiment.

A perspective illustration of the frame member is presented in FIG. 4. The tapered outer wall end portions are shown in this figure as defining a parabola in geometry. To support the fastener loads in some instances it is necessary to increase the thickness of the lug in the vicinity of the bolt. Thus, as presented in the partial side section view of figure 5, a flat piece of material 10 is attached to planar wall 2 on the upper side and a second like piece of material 12 is attached to the underside planar wall 4. Each of these pieces, referred to as "doublers", is of a width to cover the immediate end area of the lug and contains a passage or bolt hole that is the same size as bolt hole 11 and which is aligned coaxial with the latter bolt holes. A like arrangement of doublers may be included at the left end of the frame member, not illustrated in this figure.

Figure 6:
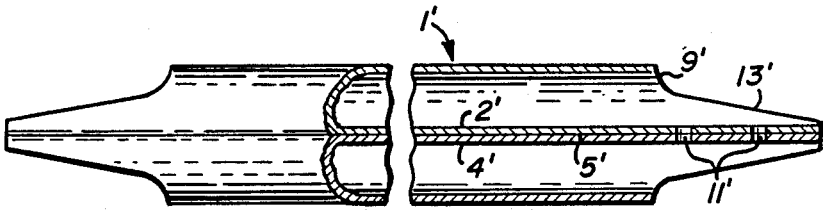
FIGS. 6, 7 and 8 illustrates a side, top and end views of a second embodiment of the invention.
Figure 8:
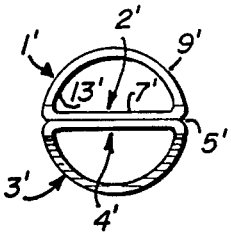
Figure 7:
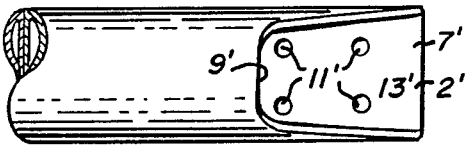

A second embodiment of the frame member is presented in FIGS. 6, 7 and 8 in which elements corresponding to those of the prior figures are identified by the same numeral primed. As shown in the side view of FIG. 6, which is partially cut away, the taper of the non-planar walls 13' is more pronounced at location 9' than the corresponding straight taper in the prior embodiment. Further a series of four bolt holes or passages 11', are included as appears in the right top section view of FIG. 7. The end view of FIG. 8 also shows a D-shaped cross section.

Figure 9:
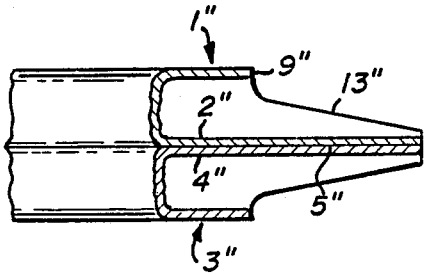
FIGS. 9 and 10 illustrates partially the side and end views, respectively, of a further embodiment of the invention.
Figure 10:
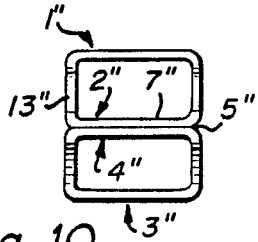

Reference is made to the partial side elevation illustration of FIG. 9 and the end view illustration of FIG. 10 of a third embodiment of the invention in which a structural member is formed of two like elements, but is formed of rectangular cross section tubes to provide lugs at each of the right and left ends. For convenience elements of this embodiment which are essentially the same as the prior embodiment are identified by the same numeral which in these figures is double primed. In other respects the techniques for manufacturing the tenon of the first embodiment are available with lugs formed in the design of this second adjustment and for all practical purposes, the lugs are essentially the same.

Figure 11:
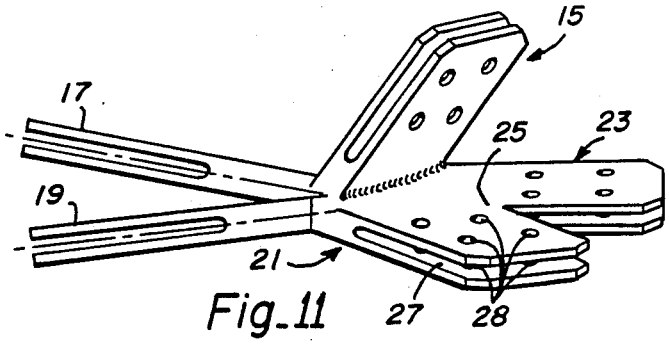
FIG. 11 illustrates in perspective view a frame joint fitting for use with the novel frame member.
Figure 12:
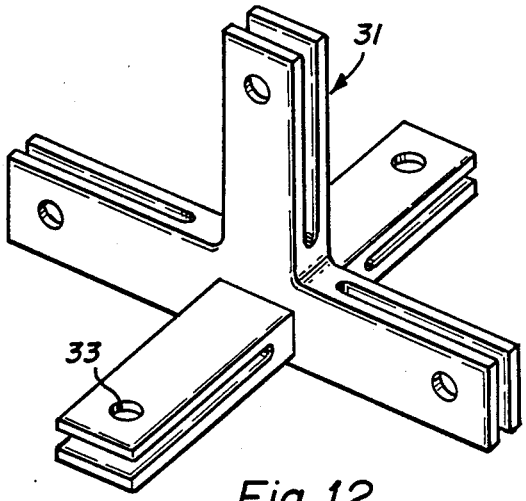
FIGS. 12 and 13 illustrate two additional fittings.
Figure 13:
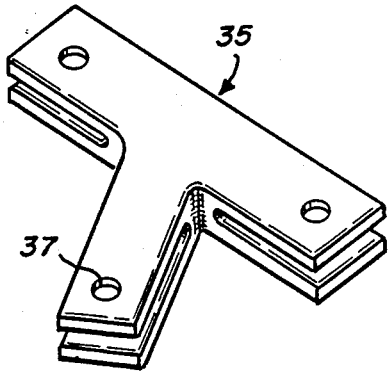

FIGS. 11, 12 and 13 shows typical joints or fittings. Considering the fitting in FIG. 11 which contains fasteners for use with the frame member illustrated in FIGS. 6 through 9, the fitting contains a series of five clevises 15, 17, 19, 21, and 23 whose axes or force lines intersect at a common point at the center of the unit.

Each clevis in the fitting is essentially identical to any of the other clevises. Thus, only clevis 21 is described in further detail. As shown clevis 21 includes a top wall 25 and bottom wall 27 which are substantially parallel and of equal width to define a slot as illustrated that is open on the front and right and left sides. As is recognized the geometric relationship is such that lug 7 in the frame member of FIG. 1 fits within the slot with the width of lug 7 and the clevis sides fit within the side wall bordering the lug end of the structural member of FIG. 1.

The clevises are oriented in particular directions and angles which are dictated by the particular requirements of a frame or truss design, the details of which are not relevant to the present invention. It is noted that in the particular design illustrated clevis 15 forms an approximately forty five degree angle with clevis 21. With the ends of the frame members installed on the respective clevises, one can visualize that the tapered or cut away end portions allow adjacent frame member ends to mate or fit within the corner area of the joint.

Suitable bolt openings or passages 28 are included within the clevis. These bolt holes are positioned so that with the lug installed, the bolt hole in the lug aligns with like holes in the clevis, allowing fastening bolt or bolts to be inserted through the clevis and lug to hold the two members together, either as a temporary measure while the frame assembly is being constructed or as a permanent fastening.

Fitting 31 in FIG. 12 contains five clevises that are oriented orthongonal to one another. Each clevis in the fitting contains one circular passage or bolt hole 33 extending therethrough to allow fastening a frame member, suitably of the type illustrated in FIGS. 1 through 4, in place using only a single bolt for each frame member end. Likewise fitting 35 in FIG. 13 is adapted to be fastened to the frame members of the construction shown in FIG. 1 and contains three clevis each of which contains a single bolt passage 37. Two of the adjacent clevis are oriented at a narrow angle with respect to one another. Hence the end tapers in the frame member allows the ends to be received within the frame member and form a joint despite the angular relationship of the clevises.

The frame member and fitting may be fabricated of various materials such as epoxy and aluminum. In aerospace applications in which light weight and stiffness are factors, the frame member is constructed of a graphite fiber reinforced epoxy material. If the material selected is aluminum, conventional tube extrusion processes may also be used to form the sections, which may then be cut to form the end geometries illustrated. The fitting may be formed of metal that is machined into the desired shape or is alternatively cast into the shape illustrated, the material "Invar", a nickel alloy, being preferred if thermal expansion characteristics and corrosion are a factor in the environment in which the assembly is to be used, and titanium and aluminum being second and third choice materials, respectively.

The cross section of each portion of the frame member is essentially constant. Where a graphite fiber reinforced epoxy material is used as the preferred materials, a mandrel of the desired "D" shape section is used to construct each of the two tubular portions of the member. Layers of graphite fiber reinforced epoxy tape or cloth are wound over the mandrel to build up the necessary thickness of material on the mandrel and this assembly is cured in a conventional manner. The mandrel is then withdrawn, simply by sliding it out of the formed structure. Thereafter the ends of the formed structure are cut, suitably with a saw to form the appropriate end tapers as illustrated in each of the embodiments, and the holes are drilled to form one half of the frame member.

The process of forming the member from the two tubular sections is inexpensive and simple. Essentially two of the D-shaped tubular members are bonded together along the common flat wall by an appropriate adhesive material which suffices for this purpose irrespective of whether the tubular member is formed of the graphite reinforced epoxy or of other materials that may be of the appropriate strength and stiffness and have the capability of being bonded together in this manner. Thereafter the ends are cut away and tapered as illustrated in FIG. 1 to form the opening exposing the top and bottom end surfaces of the lug end on each of the right and left ends of the member.

It is believed that the foregoing description of the preferred embodiments of the invention is sufficient in detail to enable one skilled in the art to make and use the invention. However, it is expressly understood that the details of the elements which are presented for the foregoing enabling purpose is not intended to limit the scope of the invention, in as much as equivalents to those elements and other modifications thereof, all of which come within the scope of the invention, become apparent to those skilled in the art upon reading this specification. Thus the invention is to be broadly construed within the full scope of the appended claims.

What is claimed is:

1. A structural member comprising: first and second substantially identical elongate generally tubular members; each of said tubular members having a relatively planar wall of predetermined length; adhesive means joining said tubular members together along said planar walls to form an integral unitary assembly with said planar walls oriented in opposed facing relationship each of said tubular members containing an outer wall portion in opposed relation to the respective planar wall and said outer wall having a wall portion terminating short of each of the right and left ends of said planar wall by a predetermined length to expose the underlying planar wall end permitting said planar wall end to form an end lug.

2. The invention as defined in claim 1 wherein each tubular member contains an essentially constant cross-section.

3. The invention as defined in claim 2 wherein each of said tubular members comprises a graphite epoxy fiber reinforced plastic material and wherein means for joining said members together comprises a structural adhesive.

4. The invention as defined in claim 1 in combination therewith a fitting, said fitting comprising at least one clevis having a pair of extending parallel walls spaced apart to define a channel, said channel being of a size slightly larger than said lug formed by said structural member for receiving therewithin said lug and wherein the width of said clevis walls being of a width slightly less than the width of said lug to fit within the side walls of said tubular members.

5. The invention as defined in claim 4 wherein each of said lugs and said clevis walls contain a bolt hole or bolt holes extending through said members orthogonal to the plane of such members, said bolt holes being arranged so that the bolt holes in said tenon align axially with bolt holes in said clevis.

6. The invention as defined in claim 1 wherein the end of each said tubular members is tapered; said taper extending to a position at an end of said tubular member slightly spaced from said planar wall portion to leave a slight end to the side wall portions located to the right and left sides of said planar wall end.

7. The invention as defined in claim 1 wherein each of said two tubular members is D shaped in cross section.

8. A frame member and joint assembly comprising in combination:

first and second substantially identical elongate generally tubular members; each of said tubular members comprising a graphite epoxy fiber reinforced plastic material; each of said tubular members having a relatively planar wall of predetermined length and further having an essentially smooth bore and a D shaped cross section;

each of said tubular members containing outer wall portions opposed in position to the respective planar wall and said outer wall having a major wall portion terminating short of each of the right and left ends of said planar wall by a predetermined length to expose the underlying planar wall end permitting said planar wall end to form an end lug; and wherein an end of each said tubular members is tapered, said taper extending to a position at an end of said tubular member slightly spaced from said planar wall portion to leave a slight edge to the side wall portions located to the right and left sides of said planar wall end;

adhesive means joining said tubular members together along said planar walls to form an integral unitary assembly with said planar walls oriented in opposed facing relationship and in substantial alignment;

fitting means adapted for connection to said frame member, said fitting comprising at least one clevis having a pair of extending parallel walls spaced apart to define a channel, said channel being of a size slightly larger than said lug formed by said structural member for receiving therewithin said lug and wherein the width of said clevis walls being of a width slightly less than the width of said lug to fit within the side walls of said tubular members;

each of said lugs and said clevis walls having at least one bolt hole extending through said clevis walls and through said lug orthongonal to the plane of such walls and lug, respectively, said bolt holes being arranged so that the bolt holes in said lug align axially with bolt holes in said clevis to permit passage therethrough of a bolt shaft.

* * * * *